US006860254B2

(12) United States Patent
Nonaka

(10) Patent No.: US 6,860,254 B2
(45) Date of Patent: Mar. 1, 2005

(54) CARBURETOR

(75) Inventor: Takumi Nonaka, Iwate-ken (JP)

(73) Assignee: Zama Japan (JP)

( * ) Notice: Subject to any disclaimer, the term of this patent is extended or adjusted under 35 U.S.C. 154(b) by 0 days.

(21) Appl. No.: 10/445,106

(22) Filed: May 23, 2003

(65) Prior Publication Data

US 2004/0035390 A1 Feb. 26, 2004

(30) Foreign Application Priority Data

May 27, 2002 (JP) ..... 2002-151879

(51) Int. Cl.[7] ..... F02D 41/00
(52) U.S. Cl. ..... 123/352; 123/328; 123/333
(58) Field of Search ..... 123/328, 333, 123/351, 352

(56) References Cited

U.S. PATENT DOCUMENTS 3,690,305 A * 9/1972 Shimada et al. ..... 123/325
3,946,705 A * 3/1976 Magnuson et al. ..... 123/41.13
4,075,988 A * 2/1978 Kato ..... 123/333
4,199,039 A * 4/1980 Ciemochowski ..... 180/177
5,709,193 A * 1/1998 Svensson et al. ..... 123/333

FOREIGN PATENT DOCUMENTS

| | | |
|---|---|---|
| JP | 49-17682 | 5/1974 |
| JP | 55-69748 | 5/1980 |
| JP | 58-101253 | 6/1983 |

* cited by examiner

*Primary Examiner*—Erick Solis
(74) *Attorney, Agent, or Firm*—Orrick, Herrington & Sutcliffe LLP

(57) ABSTRACT

A carburetor with a single fuel system that is capable of ensuring stable engine operation and lower fuel consumption. The fuel system comprises an electrical fuel control C that, in addition to mechanically coordinating the fuel flow rate with air intake by way of a metering needle 22 that operates in coordination with the throttle valve 3, opens and closes opening/closing valve 30 and cuts off and delivers fuel to the air intake passage 2 so as to maintain a required target rotational speed with little fuel consumption in a specific region of the degrees of opening of the throttle valve 3. Stable operation with minimal fluctuations in the rotational speed is ensured by cutting off the fuel when the rotational speed rises above the target rotational speed, and delivering the fuel when the rotational speed falls below the target rotational speed.

6 Claims, 5 Drawing Sheets

CARBURETOR

FIELD OF THE INVENTION

The present invention relates to a carburetor for application in supplying fuel to general purpose engines, and more particularly to a carburetor that is capable of allowing stable engine operation while achieving lower fuel consumption.

BACKGROUND OF THE INVENTION

The following devices are well known as carburetors that supply fuel to two-cycle or four-cycle general purpose engines: fixed-venturi carburetors that comprise a butterfly-type throttle valve and two fuel systems composed of a main system and a speed-reducing system as shown in Japanese Patent Application Laid-open No. 55-69748, and other publications; variable-venturi carburetors that comprise a cylindrical sliding throttle valve and a single fuel system in which the fuel delivery quantity is made variable by way of a metering needle as shown in Japanese Utility Model Publication No. 49-17682, and other publications; and carburetors that comprise a cylindrical rotating throttle valve and a single fuel system in which the fuel delivery quantity is made variable by way of a metering needle as shown in Japanese Patent Application Laid-open No. 58-101253, and other publications.

Because a carburetor comprising a sliding throttle valve or rotating throttle valve is configured with a single fuel system, it has advantages in that the fuel passage structure is simple in comparison with one comprising a main system and a speed-reducing system, and the fuel consumption from low speeds to high speeds is smooth. In common practice, carburetors comprising a single fuel system and a sliding-type or rotating-type throttle valve have a diaphragm-type constant fuel chamber.

When an engine to which fuel is supplied by the carburetor described above is operated, and particularly when the constant fuel chamber is a diaphragm type, the diaphragm may malfunction, the fuel may leak, and other problems may be brought about by engine vibration and the discharge of residual air from the constant fuel chamber, in addition to atmospheric temperature, pressure, fuel temperature, and other external conditions, and because of these factors, marked fluctuations in rotational speed of the engine cannot be avoided even at rated load operation. Marked fluctuations in the rotational speed of the engine result are an impediment in terms of achieving a smooth operation during outdoor work when using a lawn mower or the like, and also result in an increase of toxic substances in the exhaust.

Conversely, a lean mixture in a narrow air-fuel ratio range is required in order to operate an engine with good stability while reducing fuel consumption. Any inconsistencies in the fuel delivery quantity caused by variation in component precision (inherent in the carburetor itself) during manufacture, in addition to discharge of residual air, fuel leaking, and other above-described phenomena that occur during service, make it difficult to maintain a lean mixture in a narrow air-fuel ratio range.

SUMMARY OF THE INVENTION

The present invention was developed to solve the above-described problems and is aimed at allowing stable operation in an engine while realizing lower fuel consumption for a carburetor with a single fuel system that delivers fuel from a constant fuel chamber to an air intake passage.

To solve the above-mentioned problems, the present invention includes providing a fuel system comprising maximum flow regulating means for fuel delivered to the air intake passage; mechanical fuel control means for adjusting the quantity of fuel delivered to the air intake passage in accordance with the degree of opening of the throttle valve; and electrical fuel control means for delivering and cutting off the delivery of fuel to the air intake passage so as to achieve a required target rotational speed of the engine in a specific region of the degrees of opening of the throttle valve.

The maximum flow regulating means is commonly a fixed jet; the mechanical fuel control means is a device comprising a metering needle in which the surface area of the fuel passage opening is variable; and the electrical fuel control means is an apparatus comprising an electromagnetically driven opening/closing valve for opening and closing the fuel passage. To achieve the object of the present invention, it is preferable that these be arranged in the order of electrical fuel control means, maximum flow regulating means, and mechanical fuel control means in the direction from the constant fuel chamber to the air intake passage; and, in particular, that the electrical fuel control means be disposed in a location proximate to the constant fuel chamber.

The maximum flow regulating means and mechanical fuel control means described above serve to deliver fuel to the air intake passage in accordance with the engine inlet air quantity, and set the basic flow rate of the fuel. The electrical fuel control means serves to open and close the fuel passage so as to maintain a required target rotational speed in a specific region of the degrees of opening of the throttle valve, and maintains the engine rotation with fuel delivered on the downstream side thereof when closed, opens the fuel passage when the rotational speed of the engine decreases to the target rotational speed or less, and closes the fuel passage again when the rotational speed is restored to the target rotational speed. Adopting this approach allows fuel consumption to be reduced and stable operation to be achieved without marked fluctuations in the rotational speed.

Other objects and features of the present invention will become apparent from consideration of the following description taken in conjunction with the accompanying drawings.

DESCRIPTION OF THE PREFERRED EMBODIMENTS

Figure 1:
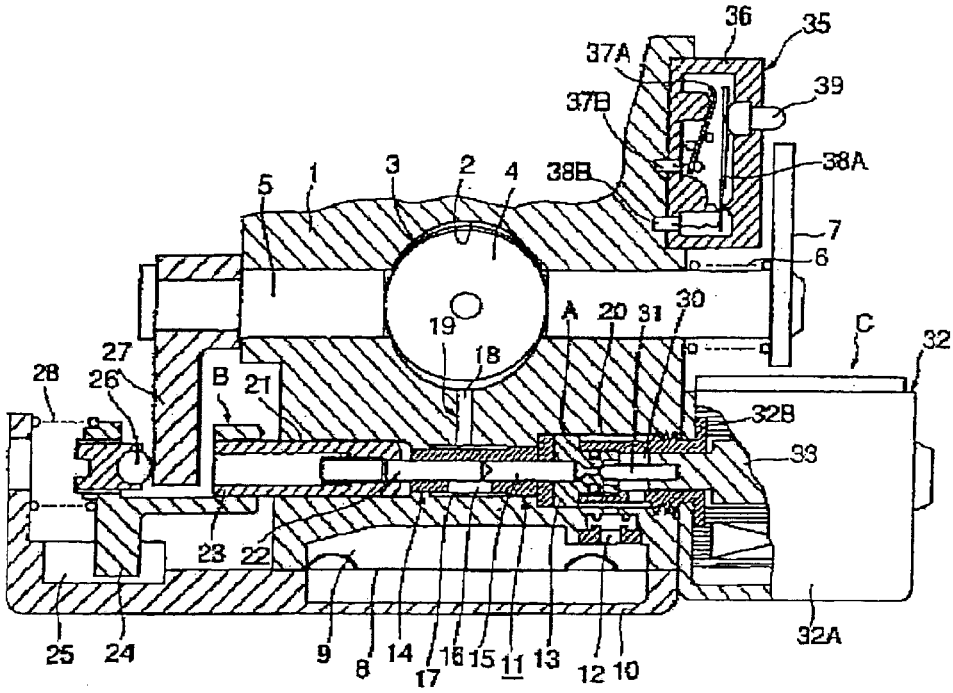
FIG. 1 is a longitudinal section showing the first embodiment of the present invention.

Describing the preferred embodiments with reference to the diagrams, FIG. 1 is a diagram showing an embodiment wherein the present invention has been applied to a carburetor comprising a butterfly-type throttle valve and a diaphragm-type constant fuel chamber. A cylindrical valve disc 4 of the throttle valve 3 is disposed in the air intake passage 2 that is formed completely through the main body 1, and a throttle valve lever 7 that is turned by the valve-closing spring 6 or accelerator operation by the driver is fastened to one end of the valve stem 5 that runs completely through the main body 1. A constant fuel chamber 9 that comprises a depression and is separated from the atmosphere by the diaphragm 8 is further disposed on one surface of the main body 1. The constant fuel chamber 9, as is well known, holds a fixed quantity of fuel by cutting off or allowing fuel delivered from a fuel pump (not shown) to flow in accordance with the displacement of the diaphragm 8, as is well known.

The fuel system 11 for delivering fuel from the constant fuel chamber 9 to the air intake passage 2 has a check valve 12 that prevents air from flowing into the constant fuel chamber 9 during priming, a fixed jet 13 (which is the maximum flow regulating means A for the fuel), a nozzle body 14, and a fuel port 18. The check valve 12 is disposed aside and facing the constant fuel chamber 9. The fixed jet 13 and the nozzle body 14 are fitted adjacent each other so as to be air- and fluid-tight in a mounting hole 20, which is formed parallel to the valve stem 5 in the portion between the constant fuel chamber 9 and the throttle valve 3 of the main body 1. The nozzle body 14 has a through-hole 15 that passes completely through the front and back and is connected to the jet hole exit of the fixed jet 13, and has one or a plurality of slit-shaped nozzle openings 16 in the peripheral side wall. The nozzle opening 16 is connected to the fuel port 18 which opens on the downstream side of the throttle valve 3 of the air intake passage 2 by way of a toroidal chamber 17.

The path that reaches the fuel port 18 by way of the jet hole of the fixed jet 13 from the above-described check valve 12, the through-hole 15 of the nozzle body 14, the nozzle opening 16, and the toroidal chamber 17 constitute a fuel passage 19. The fixed jet 13 is disposed in a location adjacent to the check valve 12.

A guide hole 21 is disposed on the same central axial line as the mounting hole 20 on the reverse side of the fixed hole 13 of the nozzle body 14. A holding member 23 in the form of a hollow shaft is fitted in the guide hole 21 wherein a metering needle 22 is held so as to protrude at the end so as to allow movement in the axial direction. The metering needle 22 is inserted in the through-hole 15 of the nozzle body 14 and the base is threadably fitted into the holding member 23, so as to allow the protruding length from the end to be adjustable, and operates so as to change the aperture surface area of the nozzle opening 16.

The holding member 23 is fitted into the guide groove 25 formed by extending the diaphragm cover 10, and is attached to the guide member 24 which moves in a linear manner. The guide member 24 holds a contact piece 26 comprising a steel ball in a freely rotatable manner. Conversely, a cam 27 is fastened to the end portion of the valve stem 5 on the reverse side of the throttle valve lever 7. The contact piece 26 is kept in constant contact with this cam 27 by way of the spring force of a pushing spring 28.

In the idle position of the throttle valve 3, the contact piece 26 makes contact with the lowest portion of the cam 27 causing the insertion of the metering needle 22 into the through-hole 15 deeper, which minimizes the aperture surface area of the nozzle opening 16. In the fully open position of the throttle valve 3, the contact piece 26 makes contact with the highest portion of the cam 27 causing the insertion of the metering needle 22 into the through-hole 15 more shallow, which maximizes the aperture surface area of the nozzle opening 16. In other words, the metering needle 22 steplessly changes the aperture surface area of the nozzle opening 16 in accordance with the degree of opening of the throttle valve 3, delivers fuel to the air intake passage 2 at a flow rate corresponding to the inlet air quantity of the engine, and sets the basic flow rate of the fuel in cooperation with the fixed jet 13.

The above-described nozzle 14, metering needle 22, holding member 23, guide member 24, cam 27, and pushing spring 28 therefore constitute the mechanical fuel control means B for adjusting the fuel delivery quantity to the air intake passage 2 in accordance with the degree of opening of the throttle valve 3.

The valve element 31 of the opening/closing valve 30 with the fixed jet 13 serving as the valve seat is subsequently inserted into the mounting hole 20 from the aperture end side. The opening/closing valve 30 is electromagnetically driven, and an actuator 32 thereof is configured such that the connector 32B fastened to and extending into the coil case 32A is attached to the main body 1 by being screwed into the mounting hole 20. The valve element 31 is attached to the end of a movable iron core (plunger) 33. The entrance of the jet hole of the fixed jet 13 is closed when the coil is nonconductive, and open when the coil is conductive. Fuel from the constant fuel chamber 9 is delivered to the nozzle body 14 by way of the check valve 12, the interior of the connector 32B, and the fixed jet 13.

A signal generator 35 is disposed on the surface of the main body 1 on the side on which the throttle valve lever 7 is positioned. The signal generator 35 comprises a fixed contact point 37A in the form of a flat spring, a movable contact point 38A mounted within the container 36, and a push pin 39 held in a linearly movable fashion in the wall of the container 36 so as to bend the moveable contact point 38A with the application of pressure and cause contact with the fixed contact point 37A. When these contact points 37A and 38A make contact, a signal sent by the energizing is transmitted from the terminals 37B and 38B to the control circuit 43 of the actuator 32. The push pin 39 is caused to move by the throttle valve lever 7, and in the present embodiment, the throttle valve lever 7 is configured so as to push the push pin 39 and send a signal when the throttle valve 3 is half open or in a range of degrees of opening that is slightly greater.

Figure 3:
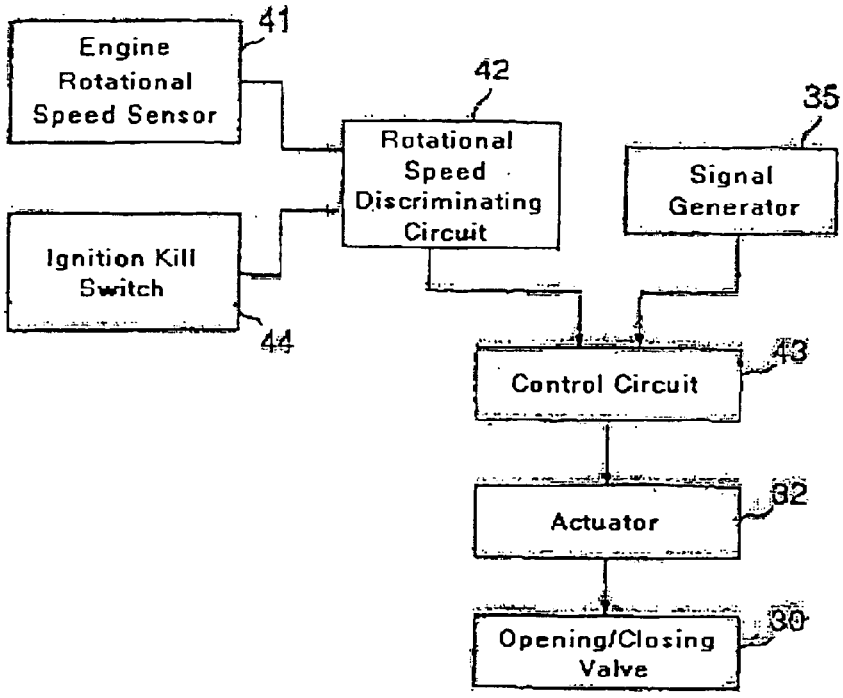
FIG. 3 is a layout drawing showing an embodiment of the electrical control circuit.

The electrical control circuit comprises an engine rotational speed sensor 41, a rotational speed discriminating circuit 42, a control circuit 43 for the actuator 32, a signal generator 35, and an ignition kill switch 44 shown in FIG. 3; and along with the opening/closing valve 30, these constitute the electrical fuel control means C for cutting off and delivering fuel to the air intake passage 2. The rotational speed can be set in any rotational speed range by manual input to the rotational speed circuit 42, and it is possible to set a plurality of rotational speed ranges.

Figure 2:
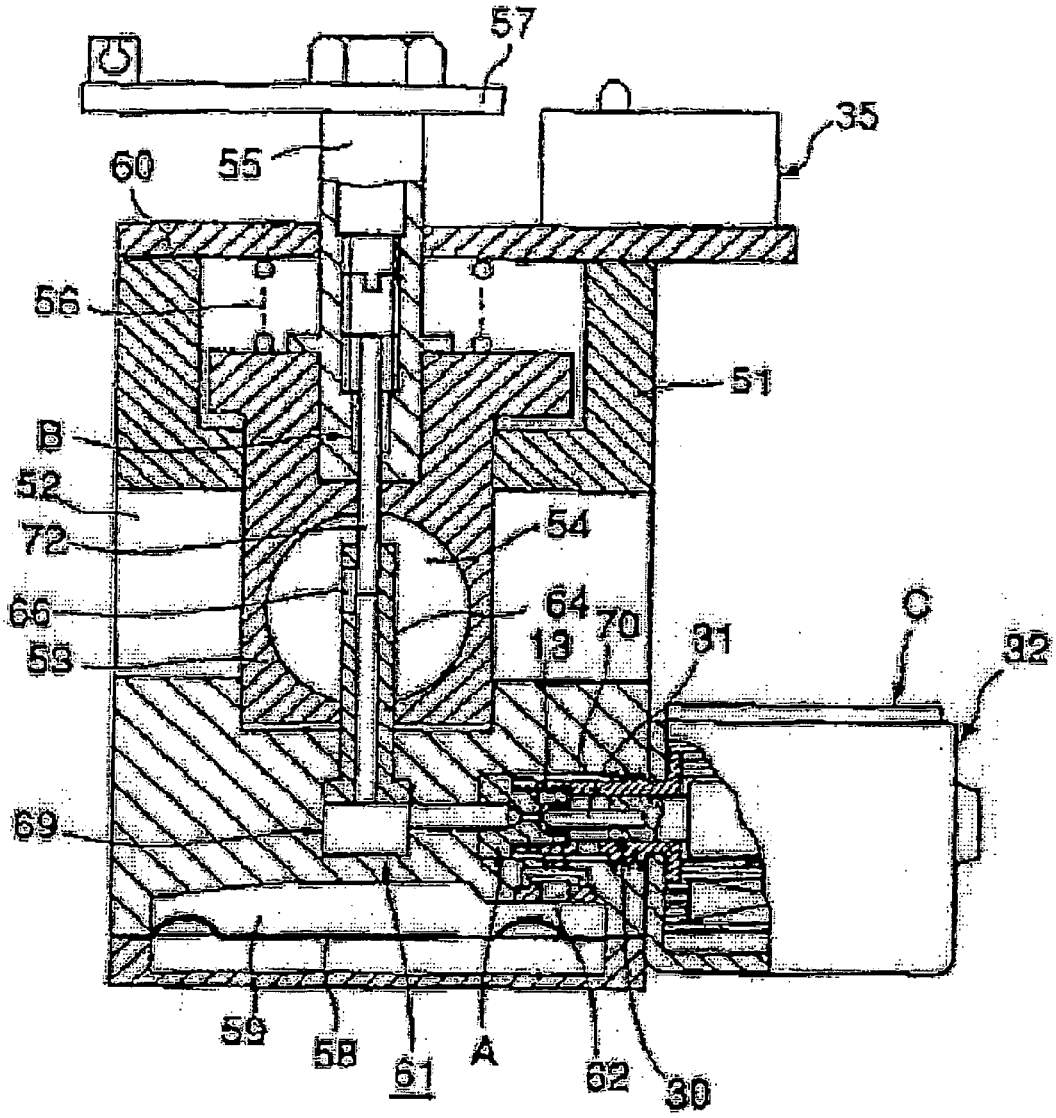
FIG. 2 is a longitudinal section showing the second embodiment of the present invention.

FIG. 2 is a diagram showing an embodiment wherein the present invention has been applied to a rotating throttle-type carburetor, and a cylindrical throttle valve 53 having a throttle through-hole 54 disposed perpendicular to the air intake passage 52 of a main body 51. A metering needle 72 is attached to this throttle valve 53 so as to allow the protruding length into the throttle through-hole 54 to be adjustable. The metering needle 72 is inserted in a nozzle body 64 that protrudes from the opposite side into the throttle through-hole 54 so that the aperture surface area of the nozzle opening 66 can be varied.

The constant fuel chamber 59 is separated from the atmosphere side by a diaphragm 58. The fuel system 61 for delivering fuel from the constant fuel chamber 59 to the air intake passage 52 has a check valve 62, a fixed jet 13 (which is maximum flow regulating means A for the fuel), and a nozzle body 64. The path that starts at the check valve 62, passes through the jet hole of the fixed jet 13, and reaches the nozzle opening 66, constitutes a fuel passage 69. The fixed jet 13 is disposed in a location adjacent to the check valve 62.

A throttle valve lever 57 is fastened to a valve stem 55 that passes completely through a main body cover 60 from the throttle valve 53 and extends to the exterior. The throttle valve 63 is moved in the axial direction by a cam mechanism (not shown) while rotated by a return spring 56 or the accelerator operation by the driver, and the air flow is controlled by the throttle through-hole 54 and fuel flow control by the metering needle 72 in the same manner as a conventional rotating throttle-type carburetor.

The above-described metering needle 72 and the nozzle body 64 constitute mechanical fuel control means B for adjusting the quantity of fuel delivered to the air intake passage 52 in accordance with the degree of opening of the throttle valve 53.

The valve element 31 of the opening/closing valve 30 with the fixed jet 13 serving as the valve seat is subsequently inserted from the aperture end side into a mounting hole 70, into which the fixed jet 13 is fitted. An actuator 32 for electromagnetically driving the opening/closing valve 30 is attached to the main body 51. A signal generator 35 operated by the throttle lever 57 is disposed in the main body cover 60. Because the structure and function of the opening/closing valve 30, the actuator 32, and the signal generator 35 are the same as described for the embodiment of FIG. 1, redundant description has been omitted.

In the present embodiment, an electrical control circuit comprising the equipment shown in FIG. 3 is provided. The circuit and the opening/closing valve 30 constitute the electrical fuel control means C for cutting off and delivering fuel to the air intake passage 52.

Figure 4:
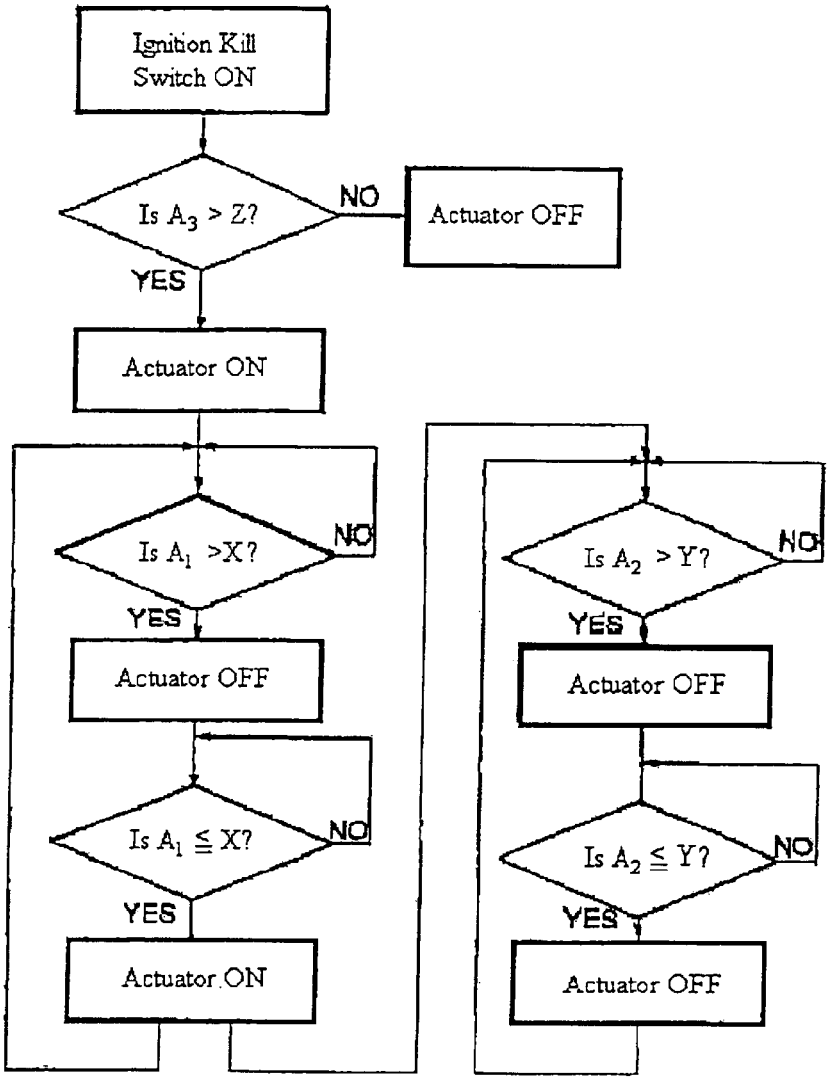
FIG. 4 is a flow chart of electrical control.
Figure 5:
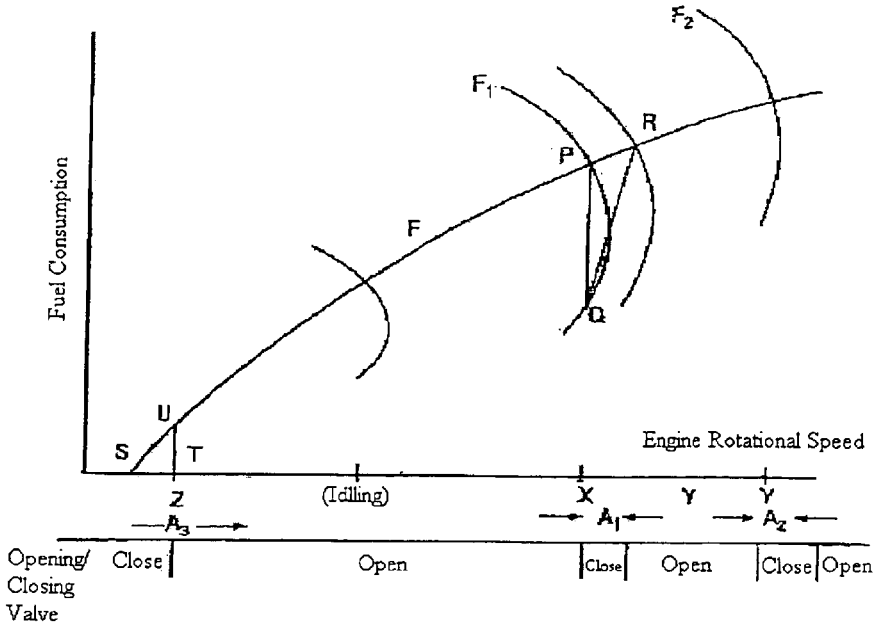
FIG. 5 is a diagram of fuel consumption curve versus rotational speed of the engine.

Here, an example of fuel control by the electrical fuel control means C in the above-described two embodiments is described with reference to FIGS. 4 and 5. The curve F of fuel consumption versus rotational speed of the engine depicted in FIG. 5 shows the fuel consumption at a constant load by the mechanical fuel control means B.

The driver initially operates the opening/closing valve 30, sets the rotational speed of the engine range, which controls the air-fuel ratio, and provides input to the rotational speed discriminating circuit 42. This rotational speed range is the range in which machinery equipped with an engine commonly operates at normal operational speed. The throttle valve levers 7 and 57 are made so as to cause the signal generator 35 to operate at a degree of opening position of the throttle valves 3 and 53 which provides air intake corresponding to this range of rotational speed.

The engine is subsequently operated under air-fuel ratio control by way of the mechanical fuel control means B, and when the rotational speed of the engine sensor 41 determines that the detected rotational speed of the engine $A_1$ has reached the rotational speed range set in advance by the rotational speed discriminating circuit 42, the throttle levers 7 and 57 actuate the signal generator 35 concurrently therewith, and a command signal that causes electrical fuel control to be performed is transmitted to the control circuit 43 of the actuator 32.

The fuel consumption by the mechanical fuel control means B when the signal generator 35 operates is shown by P on the curve F, and the flow rate of fuel required by the engine at this time is shown by the curve $F_1$. In the present embodiment, the rotational speed of the engine corresponding to the point P is designated as the target rotational speed X, and the fuel consumption Q that is below curve F but still allows the target rotational speed X to be obtained is set on the curve $F_1$.

When the rotational speed of the engine $A_1$ is higher than the target rotational speed X, the control circuit 43 demagnetizes the actuator 32 and closes the opening/closing valve 30, and the fuel passages 19 and 69 are shut off. Adopting this approach allows the fuel remaining on the downstream side of the opening/closing valve 30 of the fuel passages 19 and 69 to be delivered and the engine rotation to be maintained. When the remaining fuel becomes a small quantity or is completely delivered, the rotational speed of the engine $A_1$ decreases, and when the rotational speed of the engine is less than the target rotational speed X, the control circuit 43 magnetizes the actuator 32 and opens the opening/closing valve 30, restarting fuel supply. The above approach allows the opening/closing valve 30 to be closed again when rotational speed of the engine $A_1$ rises and exceeds the target rotational speed X. The fuel consumption resulting from these actions is shown by the P-Q-R line.

Repeating the above operations allows the rotational speed of the engine to be maintained at a target rotational speed with little fuel consumption within a preset rotational speed range. By opening and closing the opening/closing valve 30 in a small margin of rising and declining rotational speed, stable operation is made possible without marked fluctuations of rotational speed.

Fuel consumption can be automatically caused to converge at point Q by the control actions described above even if there is variation in the fuel flow rate due to variability in external conditions, service conditions, structural component precision, assembly, and other conditions.

When the throttle valves 3 and 53 are opened wide by the operation of the accelerator, the signal generator 35 ceases sending command signals, the system returns from fuel control by the electrical fuel control means C to fuel control by mechanical fuel control means B, and the throttle valves 3 and 53 are fully opened.

In the present embodiment, the control circuit 43 opens and closes the opening/closing valve 30 regardless of the signal generator 35 so that the rotational speed of the engine $A_2$ when the throttle valve is fully open is set as the fully open target rotational speed Y on the engine-required fuel curve $F_2$ when the throttle valve is fully open. In this case, when the rotational speed of the engine $A_2$ exceeds the fully open target rotational speed Y by a certain range or more and the opening/closing valve 30 is opened, the load is reduced and the required fuel can be supplied even if the engine is at a high rotational speed.

In the present embodiment, a low speed target rotational speed Z, which is set to a significantly lower value than the rated idle rotational speed or the rotational speed of the engine from cranking at engine start, is input and set into the rotational speed discriminating circuit 42. When the rotational speed of the engine $A_3$ is below this level, the opening/closing valve 30 is closed, and when above this level, the opening/closing valve 30 is opened. The fuel consumption at this time is shown by the line S-T-U. In this case, the rotational speed discriminating circuit 42 issues a command signal whereby the actuator 32 is operated by the control circuit 43 on the basis of the ON signal of the ignition kill switch 44. As described above, by not supplying fuel until the rotational speed of the engine $A_3$ rises above the low speed target rotational speed Z that has been set to a very low value, needless fuel flow is prevented when cranking fails, and engine stalling due to an overly rich mixture and an increase of fuel consumption can be avoided.

As described above, fuel consumption can be lowered and the engine can be stably operated in accordance with the present invention, in which mechanical fuel control and electrical fuel control are used jointly, and fuel is cut off and delivered so as to achieve a required target rotational speed by electrical control in a specific region of the degrees of opening of the throttle valve.

While the invention is susceptible to various modifications, and alternative forms, specific examples thereof have been shown in the drawings and are herein described in detail. It should be understood, however, that the invention is not to be limited to the particular forms or methods disclosed, but to the contrary, the invention is to cover all modifications, equivalents and alternatives falling within the spirit and scope of the appended claims.

What is claimed is:

1. A carburetor fuel system for delivering fuel from a constant fuel chamber to an air intake passage, said fuel system comprising:

maximum flow regulating means for fuel delivered to the air intake passage;

mechanical fuel control means for adjusting the quantity of fuel delivered to the air intake passage in accordance with the degree of opening of the throttle valve; and electrical fuel control means for cutting off the delivery of fuel to the air intake passage so as to achieve a required target rotational speed of the engine in a specific region of the degrees of opening of the throttle valve, wherein the electrical fuel control means cuts off fuel to the air intake passage in a region of rotational speed of the engines below a rotational speed that is set to a value below the rated idle rotational speed, in addition to cutting off and delivering fuel to the air intake passage so as to achieve a required target rotational speed of the engine in a specific region of the degrees of opening of the throttle valve.

2. The fuel system according to claim 1, wherein the electrical fuel control means cuts off and delivers fuel to the air intake passage so as to achieve a required target rotational speed of the engine when the throttle valve is fully open, and delivers fuel to the air intake passage when the rotational speed of the engine exceeds the target rotational speed by a certain range or more.

3. The fuel system according to claim 1, wherein the electrical fuel control means comprises:

an electromagnetically driven opening/closing valve for cutting off and delivering fuel to the air intake passage;

an engine rotational speed sensor;

a rotational speed discriminating circuit that is capable of setting the rotational speed by input in an arbitrary rotational speed range, and that compares the set rotational speed and the rotational speed of the engine detected by the rotational speed of the engine sensor and issues command signals;

a control circuit for magnetizing and demagnetizing an actuator for the opening/closing valve based on the command signal; and a signal generator for transmitting a command signal to the control circuit in a specific region of the degrees of opening of the throttle valve.

4. The fuel system according to claim 2, wherein the electrical fuel control means comprises:

an electromagnetically driven opening/closing valve for cutting off and delivering fuel to the air intake passage;

an engine rotational speed sensor;

a rotational speed discriminating circuit that is capable of setting the rotational speed by input in an arbitrary rotational speed range, and that compares the set rotational speed and the rotational speed of the engine detected by the rotational speed of the engine sensor and issues command signals;

a control circuit for magnetizing and demagnetizing an actuator for the opening/closing valve based on the command signal; and a signal generator for transmitting a command signal to the control circuit in a specific region of the degrees of opening of the throttle valve.

5. A carburetor fuel system for delivering fuel from a constant fuel chamber to an air intake passage, said fuel system comprising:

maximum flow regulating means for fuel delivered to the air intake passage;

mechanical fuel control means for adjusting the quantity of fuel delivered to the air intake passage in accordance with the degree of opening of the throttle valve; and electrical fuel control means for cutting off the delivery of fuel to the air intake passage so as to achieve a required target rotational speed of the engine in a specific region of the degrees of opening of the throttle valve, wherein the electrical fuel control means cuts off and delivers fuel to the air intake passage so as to achieve a required target rotational speed of the engine when the throttle valve is fully open, and delivers fuel to the air intake passage when the rotational speed of the engine exceeds the target rotational speed by a certain range or more.

6. The fuel system according to claim 5, wherein the electrical fuel control means comprises:

an electromagnetically driven opening/closing valve for cutting off and delivering fuel to the air intake passage;

an engine rotational speed sensor;

a rotational speed discriminating circuit that is capable of setting the rotational speed by input in an arbitrary rotational speed range, and that compares the set rotational speed and the rotational speed of the engine detected by the rotational speed of the engine sensor and issues command signals;

a control circuit for magnetizing and demagnetizing an actuator for the opening/closing valve based on the command signal; and a signal generator for transmitting a command signal to the control circuit in a specific region of the degrees of opening of the throttle valve.

* * * * *